US008276429B2

(12) United States Patent
Steiner et al.

(10) Patent No.: US 8,276,429 B2
(45) Date of Patent: Oct. 2, 2012

(54) HAND TOOLS AND HANDLES THEREFOR

(75) Inventors: Richard A. Steiner, East Haddam, CT (US); Frederick D. Pond, LaGrange, OH (US)

(73) Assignee: Emerson Electric Co., St. Louis, MO (US)

( * ) Notice: Subject to any disclaimer, the term of this patent is extended or adjusted under 35 U.S.C. 154(b) by 823 days.

(21) Appl. No.: 11/769,215

(22) Filed: Jun. 27, 2007

(65) Prior Publication Data

US 2008/0078273 A1 Apr. 3, 2008

Related U.S. Application Data

(60) Provisional application No. 60/848,858, filed on Oct. 2, 2006.

(51) Int. Cl.
*B25B 7/00* (2006.01)
*B21D 37/10* (2006.01)

(52) U.S. Cl. ..... 72/409.01; 72/416

(58) Field of Classification Search ..... 72/409.01, 72/409.11, 409.12, 409.19, 416, 479; 81/350, 81/489, 177.1; 16/110.1, 430
See application file for complete search history.

(56) References Cited

U.S. PATENT DOCUMENTS

| | | | | |
|---|---|---|---|---|
| 2,035,686 | A * | 3/1936 | Briegel | 72/409.01 |
| 2,760,395 | A * | 8/1956 | St Pierre | 81/177.1 |
| 4,090,420 | A * | 5/1978 | Insolio | 225/93 |
| 5,119,561 | A | 6/1992 | Olds | |
| 5,865,077 | A | 2/1999 | Moffitt, Jr. et al. | |
| 5,896,788 | A * | 4/1999 | Hreha et al. | 81/20 |
| 6,289,712 | B1 * | 9/2001 | Beetz et al. | 72/409.16 |

FOREIGN PATENT DOCUMENTS

| | | |
|---|---|---|
| DE | 3019734 | 12/1981 |
| DE | 4117899 | 11/1992 |
| DE | 9303249 | 5/1993 |
| DE | 19902882 | 8/2000 |
| EP | 228032 | 12/1986 |
| EP | 958893 | 5/1999 |
| FR | 2215294 | 8/1974 |
| WO | WO 0206011 | 1/2002 |
| WO | WO 0220226 | 3/2002 |

OTHER PUBLICATIONS

Extended European Search Report dated Nov. 19, 2009.

* cited by examiner

*Primary Examiner* — Teresa M Ekiert

(57) ABSTRACT

A hand tool includes a work portion and a user/operator interface portion comprising a handle. The handle comprises a pair of elongated members each including a generally I-shaped cross-section. Each elongated member includes a gripping portion. The gripping portion has a first surface and a primary user-interface surface having curvatures in three dimensions and preferably defined by a plurality of constant radii. As such, the handle conforms to the hands of a user/operator and reduces or eliminates undesirable pressure concentration points. The first surface of the gripping portion is provided with a finger registration portion which receives and positions the fingers of the operator around the gripping portion. The hand tool more efficiently transfers the operator input force through the hand tool to a workpiece and provides an improved comfort to the operator.

20 Claims, 4 Drawing Sheets

HAND TOOLS AND HANDLES THEREFOR

CROSS-REFERENCE TO RELATED APPLICATIONS

This present application claims priority of provisional application Ser. No. 60/848,858, titled "Hand Tools and Handles Therefor" filed on Oct. 2, 2006, the contents of which are incorporated by reference herein in its entirety.

FIELD

The present disclosure generally relates to hand tools and the interface by which a user/operator manipulates the tools such as, for example, handles.

BACKGROUND

The statements in this section merely provide background information related to the present disclosure and may not constitute prior art.

Hand tools generally comprise a work portion (i.e., that portion of the tool which interfaces with a workpiece or the like) and a user interface portion (i.e., that portion of the tool which the user/operator manipulates). It is well-known in the manufacture of hand tools to produce a hand tool from a steel stamping or a forging in order to create a desired work portion for the tool. It is further commonplace to coat the user interface portion of the tool with a soft plastic. In such hand tools, however, the user interface is not optimized to maximize the efficiency of the tool and the comfort to the user/operator.

In a hand tool, it is desirable to obtain the most efficient transfer of the force that is applied by the user/operator of the tool to the workpiece upon which the tool is acting. Simultaneously, it is desirable to minimize any discomfort experienced by the user/operator during use and manipulation of the tool. Consequently, a hand tool that possesses the appropriate strength and rigidity while improving the tactile feel and feedback for the user is sought after. Moreover, it is desirable to keep the weight of a hand tool to a minimum while maximizing its strength and its ability to transfer the maximum amount of force from the user to the workpiece.

SUMMARY

In one form, a hand tool includes a work portion adapted to interface with a workpiece, and a handle connected to the work portion. The handle includes a primary user-interface surface. The primary user-interface surface receives a force applied by a user so that the work portion can perform work on the workpiece. The primary user-interface surface has curvatures in three dimensions.

In another form, a handle for a hand tool includes a gripping portion. The gripping portion includes a primary user-interface surface to which a force is applied by a user so that the hand tool can perform work on a workpiece. The primary user-interface surface has curvatures in three dimensions.

In still another form, a crimping hand tool includes a work portion and a handle connected to the work portion. The work portion is configured to surround a tubular workpiece. The handle includes a pair of gripping portions each having a primary user-interface surface and a first surface opposite to the primary user-interface surface. The first surface defines a finger registration portion. The primary user-interface surface is formed from a contour defined by a plurality of constant radii.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
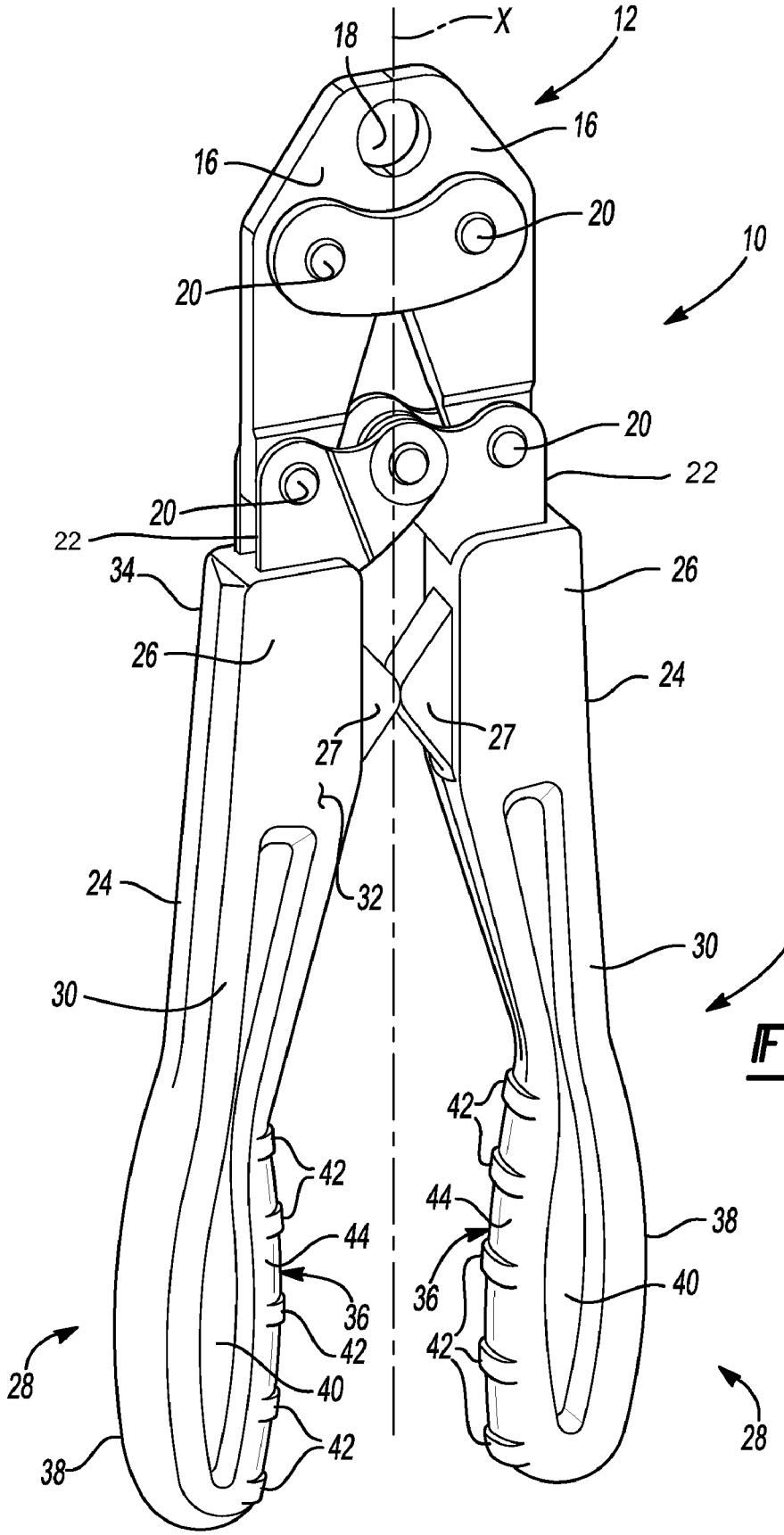
FIG. 1 is a perspective view of a crimping hand tool constructed in accordance with the teachings of the present disclosure.

The following description is merely exemplary in nature and is not intended to limit the present disclosure, application, or uses. It should be understood that throughout the drawings, corresponding reference numerals indicate like or corresponding parts and features. While reference to the subject invention is made herein in the context of a crimping hand tool, it should be understood and appreciated that the features and attributes described in the present disclosure may be employed in any of a variety of hand tools and are not limited to the device illustrated and described herein.

Referring to FIG. 1, an exemplary hand tool in the form of a crimping hand tool constructed in accordance with the teachings of the present disclosure is illustrated and generally indicated by reference number 10. The crimping hand tool 10 includes a work portion 12 and a user/operator interface portion 14. The work portion 12 in this exemplary embodiment is a crimping portion and the user/operator interface portion 14 is a handle.

The work portion 12 includes a pair of jaws 16 cooperatively defining a crimp ring holding space 18 therebetween. The jaws 16 are pivotably connected at the pivot points 20. The crimp ring holding space 18 can be enlarged as the jaws 16 move away from each other, so as to receive a crimp ring (not shown) therein. As the jaws 16 are moved toward each other, the jaws 16 create a crimp on the crimp ring so as to secure a fitting (not shown) to a tube (not shown).

The jaws 16 are connected to a linking member 22. The linking member 22 is provided with a pair of stubs (not shown) embedded in the handle 14. The handle 14 is attached to the work portion 12 at the stubs. One manner of attaching the handle 14 to the work portion 12 is by injection molding the handle 14 around the stubs.

Figure 5:
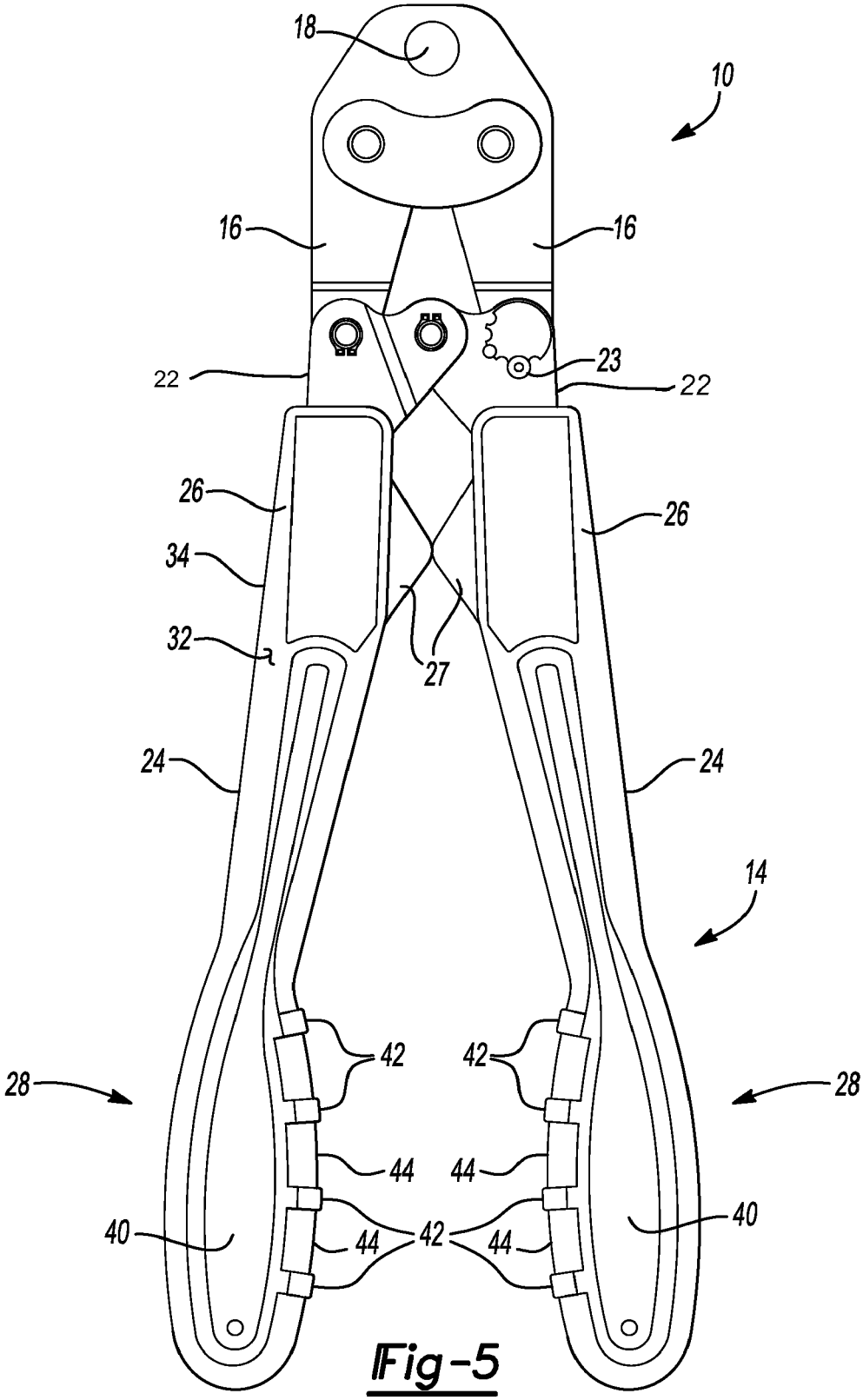
FIG. 5 is a front view of a crimping hand tool according to another form of the present disclosure.

Optionally, an adjustable lock screw 23 may be mounted to the jaws 16 for tool calibration as shown in FIG. 5.

Referring to FIGS. 1 to 4, the user/operator interface portion comprises a handle 14 that includes a pair of elongated members 24 attached to the work portion 12. The two elongated members 24 are configured and disposed in a mirror image orientation relative to a longitudinal axis X of the crimping hand tool 10. Each of the elongated members 24 is to be held in the hand of a user/operator. The elongated members 24 each have a head portion 26 that engages the linking member 22, a gripping portion 28 to enable a user/operator to grip the hand tool, and a transition portion 30 located therebetween. The handle 14 has a front surface 32 and a back surface 34. The gripping portions 28 each have a first surface 36 and a second surface 38 opposite to the first surface 36. The first surfaces 36 of the gripping portions 28 face to each other.

Figure 2:
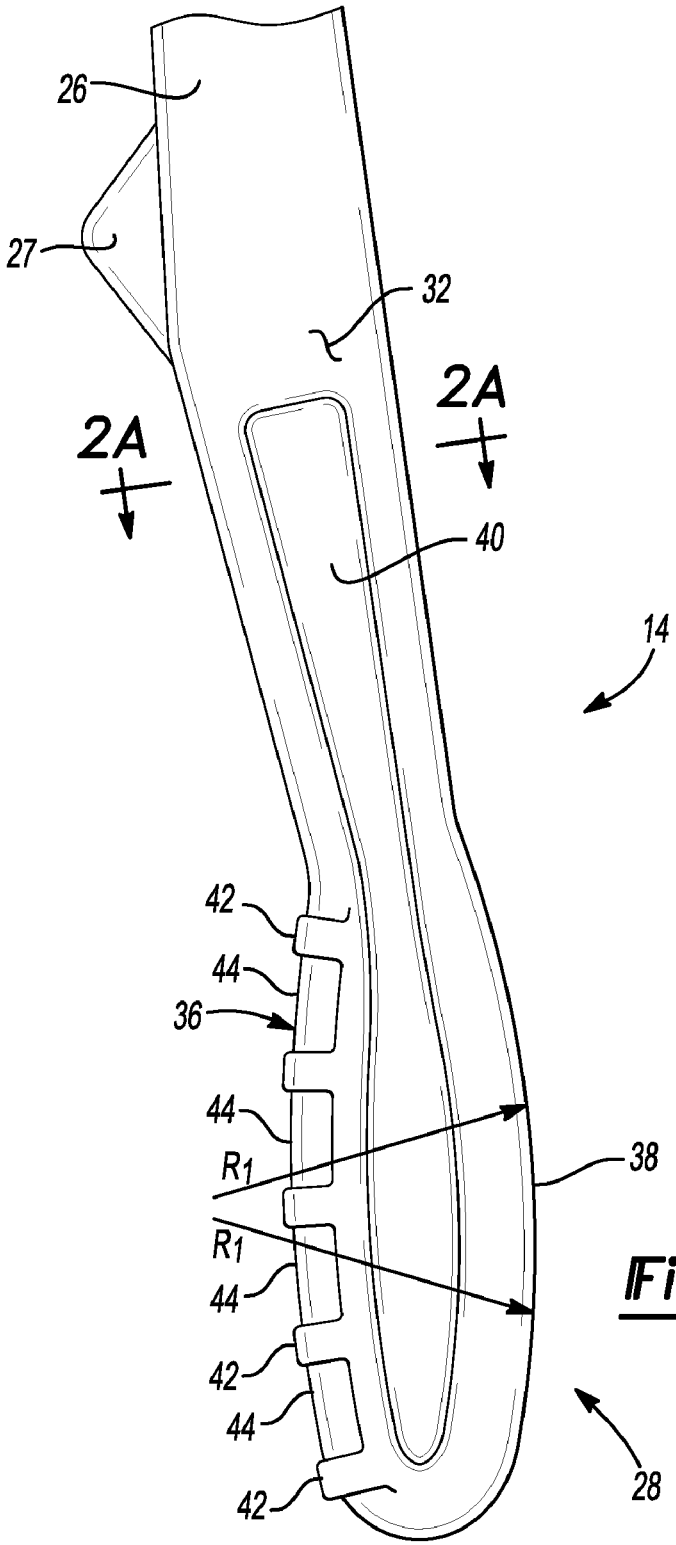
FIG. 2 is an enlarged, partial front view of the hand tool of FIG. 1, showing details of a handle.
Figure 2A:
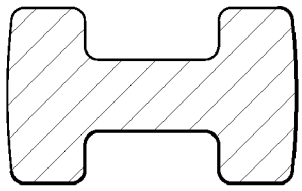
FIG. 2A is a cross-sectional view along the line 2A-2A of FIG. 2.
Figure 3:
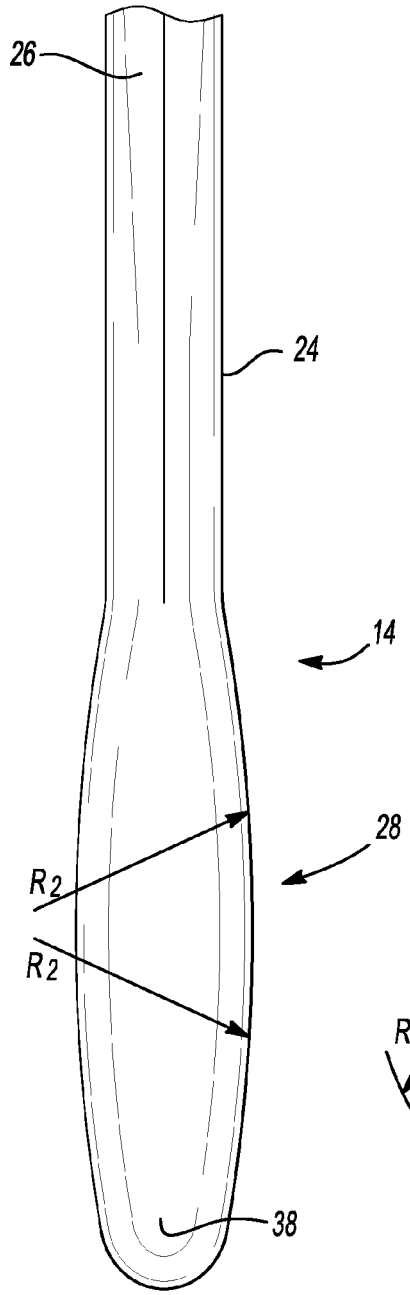
FIG. 3 is an enlarged, partial top view of the hand tool of FIG. 1, showing details of the handle.
Figure 4:
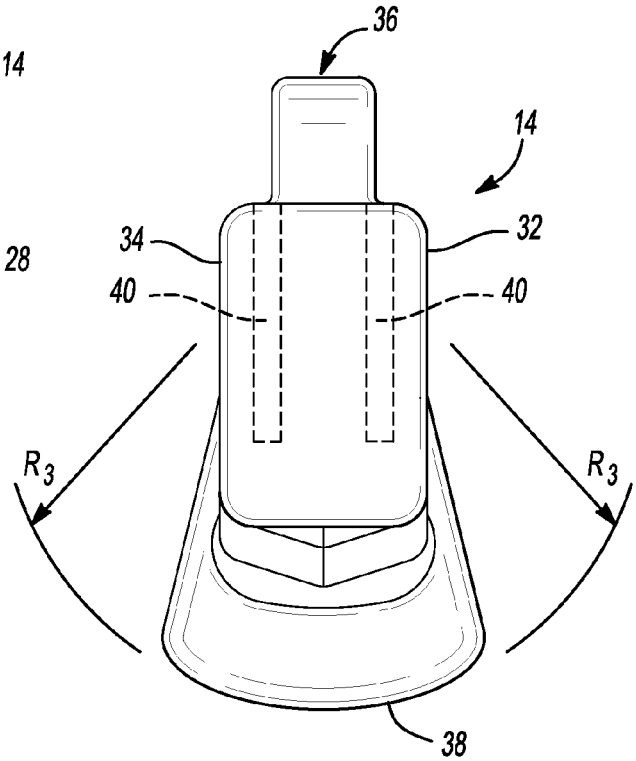
FIG. 4 is a partial side view of the hand tool of FIG. 1, showing a handle.

The elongated members 24 comprise a generally I-shaped cross-section (see FIG. 2A) which creates an elongated recess 40 on each of the front surface 32 and the back surface 34 of the handle 14. The I-shaped cross-section is preferably formed at the gripping portions 28 and the transition portions 30 so that the elongated recesses 40 extend along the length of the gripping portion 28 and the transition portion 30 to define a web portion of the I-shaped cross-section. The first surface 36 and the second surface 38 are disposed at the opposite ends of the I-shaped cross-section with the web portion disposed therebetween. The I-shaped cross-section provides improved rigidity and strength for the elongated members of the handle 14. This rigidity and strength results in any force applied to the handles 14, for example by the user/operator, being more efficiently transferred to the work portion 12 of the hand tool.

Each head portion 26 is provided with a stop 27 extending inwardly of the hand tool toward the other stop 27. The stops 27 limit the movement of the elongated members 24 toward one another. In addition, the stops 27 contribute to the tactile response and "feel" of the hand tool to the user/operator. As shown, the stops 27 are generally triangular in shape; however, the size and shape of the stops 27 may be varied as desired to produce a different feel for the hand tool 10. For example, varying the size and/or shape of the stops 27 may increase or decrease their resiliency and change the way in which the applied forces to the hand tool are opposed. As such the tactile response experienced by the user/operator can be varied.

The gripping portions 28 are contoured to comfortably conform to the hand and grip of a user/operator of the hand tool. When the user grips the gripping portions 28, a significant area of the user's palms are in contact with the second surfaces 38 of the gripping portions 28. Therefore, the second surfaces 38 function as primary user interfaces and receive a force applied by the user so that the work portion 12 can create a crimp on the crimp ring. It should be understood and appreciated that the work portion 12 of the hand tool can perform different work on the workpiece that interfaces with the work portion 12, depending on the types of the hand tools. For example, the work performed on the workpiece can be cutting, bending, drilling, punching, and forging, depending on the types of the hand tools.

The second surfaces 38 have curvatures in three dimensions (e.g., the surfaces are curved in the X-Y, X-Z, and Y-Z planes). Preferably, the second surfaces 38 are formed from a plurality of constant radii R1, R2, and R3. R1, R2 and R3 may be equal or different. With the constant radius configuration, the reaction force to the force applied to the handle by the user/operator is more evenly and comfortably distributed to the hands of the user/operator, and any pressure concentration points on the gripping portions 28 of the handle 14 are reduced or eliminated. As such, discomfort, pain and fatigue to the user/operator are likewise reduced or eliminated.

The first surface 36 of the gripping portion 28 is provided with a plurality of evenly spaced ridges 42 extending along the gripping portion 28. Recesses 44 are formed between the ridges 42. The recesses 44 and the ridges 42 combine to form finger registration locations to enable the proper and comfortable positioning of the user/operator's fingers while using the hand tool. When an user/operator's fingers are in the registration locations, the elongated recess 40 further provides additional space where the user/operator's finger tips may extend, if necessary. Consequently, the user/operator's hands and fingers are more properly and comfortably positioned and supported around the gripping portions 28. Moreover, with the described construction, the force applied by the user/operator can be more comfortably applied to the hand tool. Undesirable pressure concentration points and user/operator fatigue, therefore, may be reduced or eliminated.

The handle is preferably made of lightweight, durable polycarbonate material, such as a 30% glass-filled polycarbonate. As a result, the handle may be more than 20% lighter than a handle of a traditional hand tool. In addition, the design of the handle enables the amount of material necessary to manufacture the handle to be reduced. Such a reduction reduces the raw material cost associated with the manufacture of the hand tool.

With the construction of the hand tool described in the present disclosure, the hand tool is light weight, but yet has increased mechanical strength and efficiency. Moreover, the constant-radius contour of the handle in three dimensions, coupled with the finger registration locations, enable the user/operator to comfortably and efficiently use the hand tool.

It should be noted that the handle described in the present disclosure may be used in a variety of hand tools besides the specific crimping tool shown. Moreover, while the handle has been described to have a pair of gripping portions, it is within the scope of the present disclosure that the handle may have only one gripping portion and be operable by one hand. Accordingly, the description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. A hand tool comprising:

a work portion adapted to interface with a workpiece;

a handle connected to the work portion and including a primary user-interface, the primary user-interface receiving a force applied by a user so that the work portion can perform work on the workpiece;

wherein the primary user-interface is a surface defined by a first constant radius of curvature in a first plane, a second constant radius of curvature in a second plane, and a third constant radius of curvature in a third plane;

wherein the first plane is perpendicular to both the second plane and the third plane, and the second plane is perpendicular to the third plane; and wherein the first constant radius of curvature, the second constant radius of curvature, and the third constant radius of curvature are not equal.

2. The hand tool according to claim 1, wherein the handle comprises a first surface opposite to the primary user-interface, such that when a user operates the handle, the first surface and the primary user-interface are held in a hand of the user.

3. The hand tool according to claim 1, wherein the handle includes a pair of gripping portions each having the primary user-interface and a first surface opposite to the primary user-interface.

4. The hand tool according to claim 3, wherein the first surfaces of the gripping portions each include a finger registration portion.

5. The hand tool according to claim 4, wherein the finger registration portions include ridges spaced along the length of the first surfaces of the gripping portions and recesses between the ridges configured to position a finger by engaging a front surface of the finger and side surfaces of the finger normal to the front surface.

6. The hand tool according to claim 3, wherein the gripping portions each comprise a generally I-shaped cross-section.

7. The hand tool of claim 3, wherein at least one of the first, second, and third constant radii extends along an entire length of the gripping portion.

8. The hand tool according to claim 1, wherein the handle is integrally molded onto the work portion.

9. The hand tool according to claim 1, wherein the work portion is configured to enclose a part of the workpiece to create a crimp on the workpiece.

10. The hand tool according to claim 1, wherein the hand tool is a crimping hand tool.

11. A crimping hand tool comprising:

a work portion configured to surround a part of a tubular workpiece;

a handle connected to the work portion, the handle including a pair of gripping portions each having a primary user-interface surface and a first surface opposite to the primary user-interface surface;

wherein the first surface defines a finger registration portion;

wherein each primary user-interface surface comprises a first constant radius of curvature having a first value measured in a first plane, a second constant radius of curvature having a second value measured in a second plane, and a third constant radius of curvature having a third value measured in a third plane;

wherein the first plane is perpendicular to both the second plane and the third plane, and the second plane is perpendicular to the third plane; and wherein at least one of the first, second, and third constant radii extends along an entire length of the gripping portion.

12. The crimping hand tool according to claim 11, wherein the work portion is configured to form a space for receiving the part of the tubular workpiece.

13. The crimping hand tool of claim 11, wherein the first value, the second value, and the third value are different from each other.

14. The crimping hand tool of claim 11, wherein the finger registration portion includes ridges and recesses between the ridges configured to position a finger by engaging a front surface of the finger and side surfaces of the finger normal to the front surface.

15. A hand tool comprising:

a work portion adapted to interface with a workpiece;

a handle connected to the work portion, the handle comprising a primary user-interface, a first surface opposite the primary user-interface, the handle further comprising a substantially I-shaped cross section;

wherein the first surface defines a finger registration portion;

wherein the primary user-interface is a single contoured surface defined by a single constant radius of curvature of a first value measured in a first plane, a single constant radius of curvature of a second value measured in a second plane, and a single constant radius of curvature of a third value measured in a third plane;

wherein the first plane is perpendicular to both the second plane and the third plane, and the second plane is perpendicular to the third plane; and wherein at least one of the single constant radii of the first, second, and third values extends along an entire length of the primary user-interface.

16. The hand tool of claim 15, wherein the handle comprises a polycarbonate material.

17. The hand tool of claim 16, wherein the polycarbonate material is glass-filled.

18. The hand tool of claim 17, wherein the handle comprises a 30% glass-filled polycarbonate material.

19. The hand tool of claim 15, wherein the first value, the second value, and the third value are different from each other.

20. The hand tool of claim 15, wherein at least two of the single constant radii of the first, second, and third values extend along an entire length of the primary user-interface.

* * * * *

UNITED STATES PATENT AND TRADEMARK OFFICE

CERTIFICATE OF CORRECTION

PATENT NO. : 8,276,429 B2
APPLICATION NO. : 11/769215
DATED : October 2, 2012
INVENTOR(S) : Steiner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 926 days.

Signed and Sealed this
Sixteenth Day of September, 2014

Michelle K. Lee

Michelle K. Lee
*Deputy Director of the United States Patent and Trademark Office*